US005299933A

United States Patent [19]

Mosci

[11] Patent Number: 5,299,933

[45] Date of Patent: Apr. 5, 1994

[54] ROTARY KILN WITH A POLYGONAL LINING

[75] Inventor: Ricardo A. Mosci, Butler, Pa.

[73] Assignee: Quigley Company, Inc., New York, N.Y.

[21] Appl. No.: 815,102

[22] Filed: Dec. 24, 1991

[51] Int. Cl.[5] ..... F27B 7/00

[52] U.S. Cl. ..... 432/103; 432/110; 432/118; 432/119

[58] Field of Search ..... 432/103, 110, 118, 119

[56] References Cited

U.S. PATENT DOCUMENTS

| | | | |
|---|---|---|---|
| 3,206,526 | 9/1965 | Rygaard | 432/119 |
| 3,330,546 | 7/1967 | Bryan | 432/119 |
| 3,362,698 | 1/1968 | Cerny et al. | 432/119 |
| 3,593,970 | 7/1971 | Seebald | 432/119 |
| 4,200,469 | 4/1980 | Touborg | 106/100 |
| 4,289,479 | 9/1981 | Johnson, Jr. | 432/119 |
| 4,344,596 | 8/1982 | Hjaeresen | 248/550 |
| 4,978,294 | 12/1990 | Uemura et al. | 432/119 |
| 5,097,773 | 3/1992 | Freeman | 432/118 |

FOREIGN PATENT DOCUMENTS 1814484 6/1970 Fed. Rep. of Germany .

*Primary Examiner*—Henry C. Yuen
*Attorney, Agent, or Firm*—Pennie & Edmonds

[57] ABSTRACT

A rotary kiln having a polygonal lining is disclosed for pyro-processing cement, lime, other minerals, as well as other materials. Specifically, utilizing a polygonal lining of brick or a refractory or ceramic material having between 3 and 12 sides improves the heat efficiency or heat transfer between high-temperature gases and a burden of material to be processed by the kiln. Such an efficient utilization of the gas heat is due to various factors which cause a larger amount of the burden to be more quickly exposed to the high temperature gases. These various factors include increased tumbling, increased residence time, decreased degree of filling, and increased surface exposure.

22 Claims, 5 Drawing Sheets

ROTARY KILN WITH A POLYGONAL LINING

TECHNICAL FIELD

This invention generally relates to kilns and, more particularly, to rotary kilns having a polygonal refractory lining for pyro-processing cement, lime, and other minerals.

BACKGROUND OF THE INVENTION

Conventional rotary kilns utilized for pyro-processing cement, lime, and other minerals, are commonly lined with refractories or bricks that protect the shells of rotary kilns against heat and abrasion. Generally, tapered bricks are placed in a ring manner along the circumference of the steel shell of the kiln. In addition to protecting the steel shell, the refractory bricks reduce the heat loss through the steel shell.

Unfortunately, conventional rotary kilns with present refractory lining designs are still heat inefficient, resulting in a prohibitively high fuel cost. For example, although the theoretical heat of formation of a Type I cement clinker is 420 kcal/kg, typical dry and wet process kilns consume far greater energy, approximately 1100 kcal/kg (38% heat efficiency) and 1300 kcal/kg (32% heat efficiency), respectively. Similarly, for lime kilns, typical heat efficiencies are in the range of about 40%. Such low heat efficiencies result from high radiative loss, in addition to heat loss resulting from surplus heat being dissipated in the stack gases, and the processed product itself.

SUMMARY OF THE INVENTION

I have invented a kiln having improved heat efficiencies and which overcomes the deficiencies of the prior art. In particular, the kiln of the present invention affords a high heat efficiency and, moreover, does not deleteriously affect the throughput of the kiln.

The present invention relates to a kiln comprising a shell having a inner wall and a lining disposed within and adjacent at least a portion of the inner wall. The lining has a generally polygonal cross sectional configuration. These kilns are used for processing material such as, for example, cement, lime, or other minerals, as well as other materials such as wood pulp. Utilizing a polygonal lining at least improves the heat efficiency or heat transfer between high-temperature gases and a burden or material to be processed within the kiln. Such an efficient utilization of the gas heat is due to various factors which cause a larger amount of burden to be more quickly exposed to both the high temperature gases and lining. These various factors include increased tumbling, increased residence time, decreased degree of filling, and increased surface exposure.

In a preferred embodiment, the polygonal lining is formed by installing pre-shaped bricks or by casting an appropriate heat and abrasion resistant refractory or ceramic material onto the inner wall of the shell such that when viewed along its longitudinal axis, the lining has a polygonal cross-section. Typically, two to five different shapes of bricks are necessary to construct each of the N sides of the polygon, N typically being between 3 and 12. Alternatively, each of the sides of the polygon can be successively cast onto the inner wall of the shell.

BRIEF DESCRIPTION OF THE DRAWING

Additional details of the invention may be obtained by reading the following description in conjunction with the appended drawings in which.

DETAILED DESCRIPTION

Figure 1:
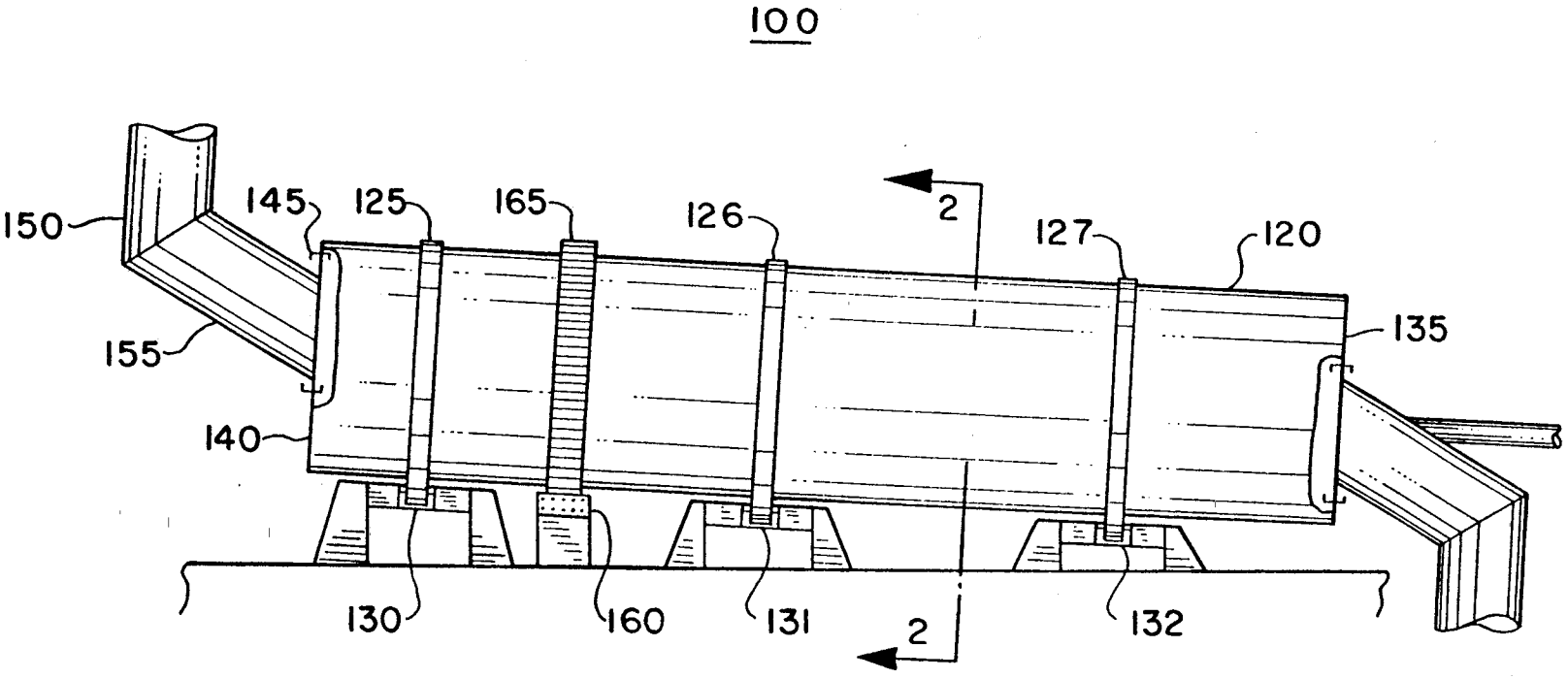
FIG. 1 is a side view of a rotary kiln according to the present invention having a polygonal cross-sectional lining.
Figure 2:
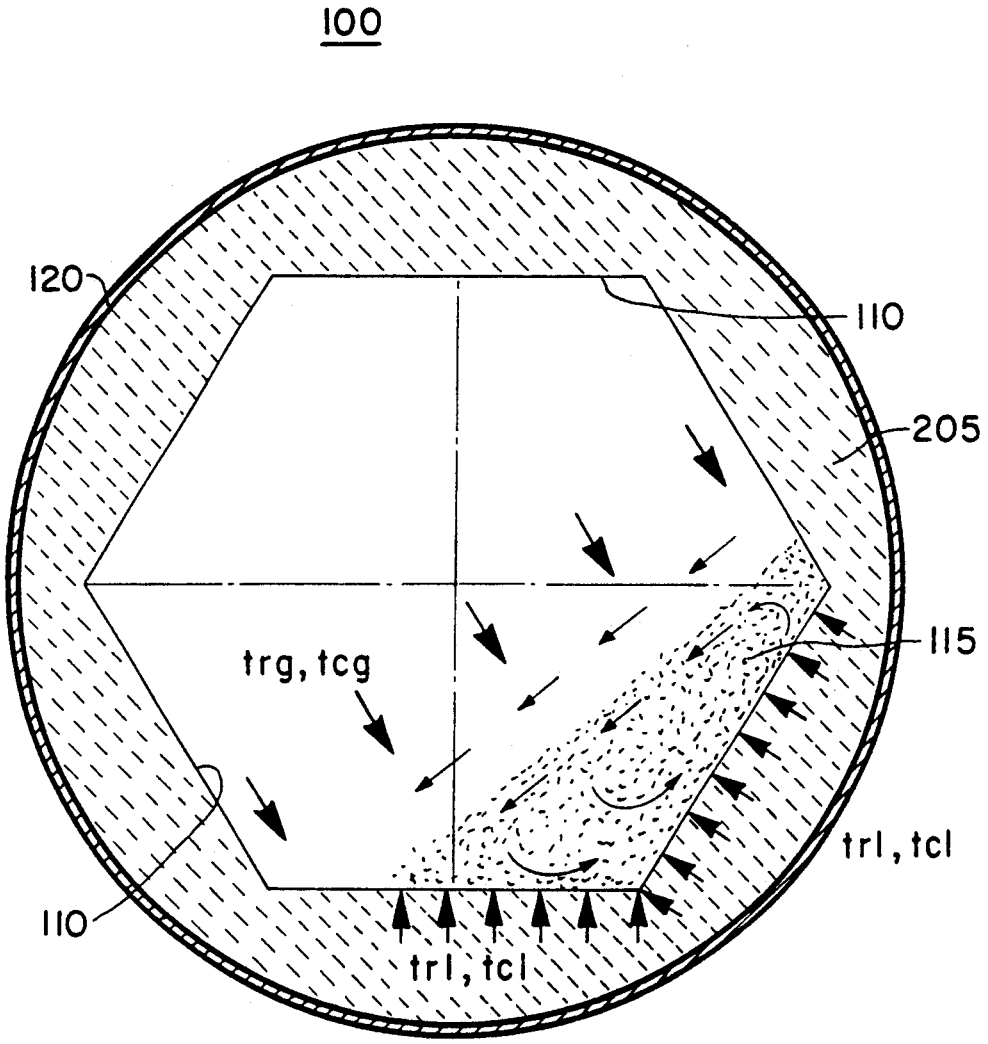
FIG. 2 is a cross-sectional view of the present inventive rotary kiln that depicts the heat transfer components therein.

Referring to FIGS. 1 and 2, a rotary kiln 100 in accordance with the principles of the invention is shown. The rotary kiln 100 has a lining 105 which when viewed along the longitudinal axis defines an open processing zone having generally a polygonal cross-section as shown in FIG. 2. Lining 105 has a processing surface 110, as shown in FIG. 2, upon which the burden 115 to be processed falls and moves as the kiln 100 rotates.

To achieve this configuration, the lining 105 is formed inside the inner wall of the Kiln shell 120. The lining is made of material which is sufficiently resistant to the environment to which it will be exposed. For a cement kiln, the lining material preferably is an abrasive and heat resistant castable ceramic or brick material. As shown in FIG. 1, the kiln shell 120 is supported by riding rings or tires 125 through 127 that engage steel rollers 130 through 132, respectively. Steel rollers 130 through 132 are supported on a steel frame. Rotary kiln 100 is positioned such that the discharge end 135 of the shell 120 is at a level sufficiently lower that the feeding end 140 to cause the material to be processed to move toward the discharge end.

If desired, a flexible seal 145 is preferably attached to the feeding end 140 so as to at least cover a portion thereof. A funnel 150 of suitable material may be connected to the flexible seal 140 by an extension tube 155. A small hole in the center of the seal 145 allows the tip of tube 155 to extend slightly into the feeding end 140 of kiln 100 for feeding the material to be processed, such as cement or lime, within the pyro-processing zone of the kiln. After the burden or material is processed, it passes through the kiln to the discharge end 135.

In operation, rotary kiln 100 is driven by a motor reductor set (not shown) connected to pinion 160 and main gear 165, as illustrated in FIG. 1. The operation of rotary kilns and method of firing are well known in the art, and accordingly, will not be discussed here. However, for a detail description of the operation of rotary kilns and method of firing, see, for example, U.S. Pat. Nos. 4,200,469 and 4,344,596, the content of which are expressly incorporated herein by reference to the extent needed to understand this aspect of the invention.

In one embodiment, the lining may be formed by a series of bricks which are laid upon the inner wall of the shell in a manner designed to reproduce the desired polygonal pattern. The bricks are preferably tapered and laid so that they are maintained in the desired pattern without the use of mortar or grout. Optionally, mortar and/or grout can be used to level or fill spaces or irregularities between and among the shell and bricks. Further, the bricks may be mortared together for better structural integrity which may be needed in certain applications, e.g., high feed, high speed processing of abrasive pyro-processable materials or for kilns that have mechanical problems.

Figure 3:
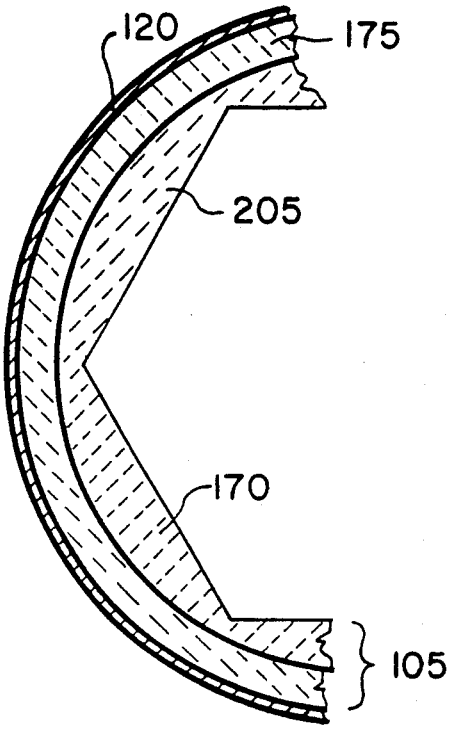
FIGS. 3–5 are partial exploded views of alternative lining constructions for the kiln of FIG. 2.

Optionally, in higher temperature applications, the bricks 170 may be placed as shown in FIG. 3, upon an initial layer of a ceramic fiber blanket 175, which acts as an insulator to reduce the degree of heat lost through shell 120.

In an alternative embodiment, the lining 105 may be formed of a granular refractory material which is mixed with water to form a concrete-like material that is cast or gunited onto the inner wall of the shell 120. The particular configuration may be achieved by the use of forms and appropriate spacers which define the volume which is to be filled or cast with the refractory material. These aspects of the invention are shown in FIGS. 4 and 5.

When castable refractory material is used, it is secured to the shell wall by V-shaped anchors 180 which are generally spot welded to the shell wall prior to installation of the refractory material. These anchors are attached to the wall in a predetermined pattern and have a height of about ½ to ¾ the total thickness of the refractory material that is to be applied. The wide variety and selection of such anchors as well as the appropriate material, shape and design for any particular installation is well known in the art.

Figure 4:
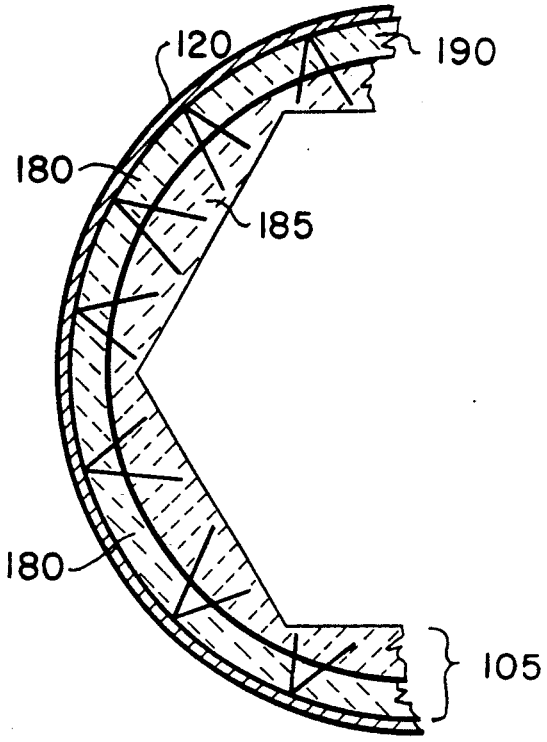
Figure 5:
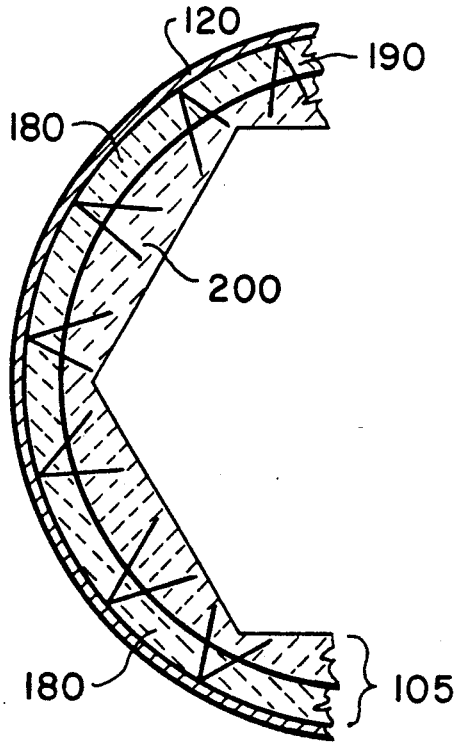

For high temperature applications, the refractory material 185 may be cast upon a ceramic fiber blanket 190 which is placed between and around the anchors to insulate the shell 120 as shown in FIG. 4. A similar result can be obtained instead by using two types of refractory material as shown in FIG. 5. An initial refractory layer 195 of a lightweight castable material is applied onto the inner wall of the shell 120. After curing, layer 195 is coated with a higher temperature, higher abrasion resistance refractory material 200. This type of combination of different abrasion materials is well known in the art for use, e.g., in the processing of molten metals.

Also, the polygonal lining 105 may be formed by precasting an appropriate refractory material into a form which has a base shaped to conform to the cylindrical wall of the shell. The form may be made of steel to facilitate attachment to the steel shell. After the refractory form material is precast into the form, the form is inserted onto the kiln shell 120 and secured by bolting or welding. Further, combinations of cast shapes, shaped bricks and/or mortar or grout may be used to achieve the desired polygonal configuration of the lining 105.

To obtain the polygonal cross-section of the lining, the bricks 170 are attached to the inner shell in a polygonal pattern by conventional methods, such as R.K.B. arch or wedge methods with or without mortar. Variously shaped bricks, preferably between 2 and 6, will be used to define each of the N sides of the polygonal cross-section. Each brick has two opposing faces. One substantially planar face 205 is directed radially inward toward the pyro-processing zone within the kiln 100 and another slightly curved face is directed towards and is configured to conform to the wall of shell 120. These refractory bricks are wedged against one another along the circumference of the shell and extend inwardly to define the desired polygonal cross section and the outline of the pyro-processing zone. It should be understood that the entire kiln does not have to include the lining of the invention, although it should be installed at least in the calcining and discharge zones.

The number and shapes of the bricks or cast lining can be varied in accordance with the size of the kiln, the thickness of the lining, and the number of sides of the polygon. Between 3 and 12 sides and, preferably, between 6 and 12 sides will be needed to assure a high heat efficiency, depending on the diameter of the kiln. Also, the use of 12 sides or less provides an angle between adjacent sides of 150° or less. This achieves the benefits of the advantages described hereinbelow.

Figure 10:
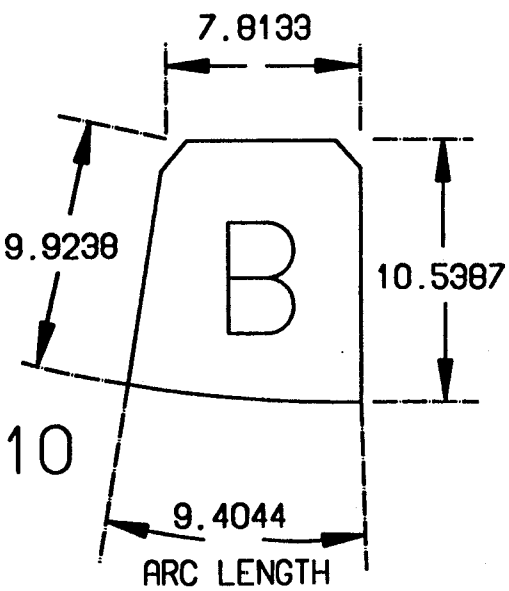
FIGS. 9 and 10 are views of bricks A and B, respectively, for use in the construction of the lining shown in FIG. 8.

Moreover, it is anticipated that where each side of the polygonal cross-sectional opening meet, a slight discontinuity, or flat or curved transaction area may exist due to a mismatch in the brick positioning near the edge of the side thereof. This mismatched joint can also be filled with mortar, if desired, to obtain the desired shape. Further, to reduce or minimize pinch spalling and displacements, refractory bricks 170 may be bevelled at their inner chord or "hot face" as shown in shape B of FIG. 10.

In the preheating, calcining, and sintering zones of prior art kilns, approximately 90% of the heat supplied to the material is by radiative and convective heat transfer from the gases, with the remaining 10% due to heat transfer from the lining to the material as a result of the tumbling therein.

Unfortunately, the typical charge material, such as cement, lime, dolomite, and the like, are heat insulators. Thus, although thin surface layers of the charge material may be heated to the appropriate processing temperature, if the layer is not quickly reheated, part of the heat originally absorbed will be back reflected and retransferred to the gases.

The kiln of the present invention utilizes a polygonal lining to improve the heat efficiency or heat transfer between high-temperature gases and a burden or material to be processed therein. Such an improved and efficient utilization of the gas heat results in a lower exit temperature, as well as lower gas heat loss. More specifically, by employing the polygonal lining design, it has been discovered that a larger burden surface area can be more quickly exposed to the high temperature gases in order to promote heat transfer by the aggregate effect of various factors, such as increased tumbling, increased residence time, decreased degree of filling, and increased surface exposure.

Advantageously, utilizing a polygonal lining offers superior heat transfer conditions than those employing a cylindrical lining design. This advantage of the rotary kiln 100 according to the present invention is exemplified upon examining the heat transfer mechanism within the inventive rotary kiln.

Heat required for burning the clinker in the rotary kiln is supplied by high-temperature gases produced, for example, by a combustion process. These gases include carbon dioxide, water vapor and potassium chloride vapor. For there, however, to be a net transmission of heat to the clinker, there must be a temperature gradient between the two materials. For example, in the present case between the gases and the clinker. The amount of transmitted heat, Q, by the gas in a time, t, is given by the general heat transfer equation:

$$Q=a(T_g-T_m)FT$$

where a is the heat transfer coefficient; $T_g$ is the gas temperature; $T_m$ is the material temperature; and F is the surface area of the material exposed to the gases.

By judiciously selecting the temperature gradient, $T_g-T_m$, it is possible to control the amount of heat, Q, transmitted to the material. Under unfavorable conditions, the practice of the prior art to effectuate high heat transfer was to increase the temperature gradient. This, however, resulted in a higher exit gas temperature, if the gas temperature was increased to effectuate higher heat transfer, in addition to higher radiative heat loss from the exiting gas.

Heat transfer within the inventive rotary kiln 100 is in general governed by the above heat transfer equation and comprises, but is not limited to, at least four different components, as illustrated in FIG. 2:

radiative heat transfer from the gases to the material ($t_{rg}$);

convective heat transfer between the gases and the material ($t_{cg}$);

radiative heat transfer between the lining and the material ($t_{rl}$); and conductive heat transfer from lining to material ($t_{cl}$).

It has been discovered that employing a polygonal lining unexpectedly improves favorably the above four different heat transfer components for the burden to be processed. Specifically, it, among other things, decreases the time a specific particle of the burden remains at the surface after absorbing heat from the gases, i.e., enhanced tumbling, and advantageously improves the heat transfer because in general less heat is re-transferred to the lining and gases. Additionally it increases the residence time of the burden in the kiln; increases the surface exposure of the burden; and decreases the degree of filling within the kiln. As discussed below, these features, as an aggregate effect, improve the heat transfer within the kiln without decreasing the throughput.

One factor in the improved heat efficiency is the increased residence time. The residence time is the time required, under steady state conditions, for a given particle of the charge material to reach the lower portion or end of the kiln. In general, the residence time, T, is dependent upon the length, l, of the kiln, the revolution speed, N, the diameter, D, of the kiln, and the slope, S:

$$T=\frac{kL}{NDS}$$

Moreover, k is a constant depended on the cross-sectional area of the kiln and the characteristic properties of the burden.

The residence time can be measured in the lab by using a technique in which a specified amount of sand is fed to the kiln. After a specified time, the amount of burden that has reached the discharge end is then measured.

Comparisons between circular and polygonal cross-sectional kilns having equivalent diameters and all other parameters equal indicate that a polygonal lining can increase the residence time of the burden by about 4–5% for polygonal cross-sectional kiln. This larger residence time allows for the high-temperature gases to transfer more heat to the burden for a given axial length within the kiln.

A further factor improving the heat efficiency is the decreased degree of filling. The degree of filling of the kiln, as used herein, refers to the ratio between the cross-sectional area of the burden and the cross-sectional area of the kiln under steady state conditions. During the pyro-processing, as the burden traverses the kiln it loses weight and volume, with the degree of filling varying from zone to zone. For example, at the feed end, the degree of filling is high, but then decreases at the calcining zone as the carbon dioxide and water vapors are driven off. Near the burning zone, the degree of filling increases because of the coating layer which has formed.

A distinct advantage of using the polygonal lining is that with the polygonal cross-section there is a lower degree of filling, which affords better heat transfer to the burden since a larger percentage of the surface area of the burden may be exposed to the gas with respect to the cross-sectional area of the kiln.

Results from experimental practice, for example, show that for a scale model hexagonal cross-sectional kiln, the degree of filling is about 4%, compared to 6.9% for circular cross-sectional kilns of an equivalent diameter. Note that for hexagonal cross-sectional kiln, measurements were performed at different rotation positions and the average degree of filling computed.

The rotary kiln of the present invention is constructed in such a manner as to improve the heat efficiency therein by the aggregate effect of more quickly exposing a larger quantity of burden to the high temperature gases. For increasing the heat transfer, the surface area exposed to the gases and lining is effectively larger in the polygonal cross-sectional kiln than in cylindrical cross-sectional kilns. This larger exposed surface area results in a higher radiative and conductive heat transfer from the lining to the burden, and a higher radiative heat transfer from the gases to the burden.

Figure 6:
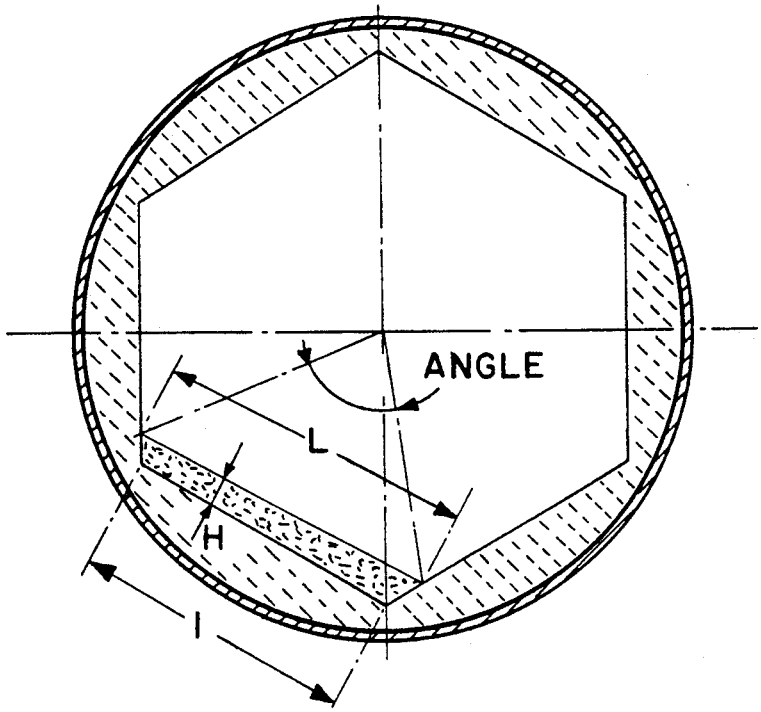
FIG. 6 is a cross-sectional view of a hexagonal cross-sectional kiln which illustrates the degree of surface exposure of the burden to the lining and gases therein.

Referring to FIG. 6, in a scale-model hexagonal cross-sectional kiln with a diameter of 15.4 cm, 7.5 cm (L) of the burden is exposed to the high-temperature gases, and 9 cm (21) is exposed to the radiative heat from the lining.

Figure 7:
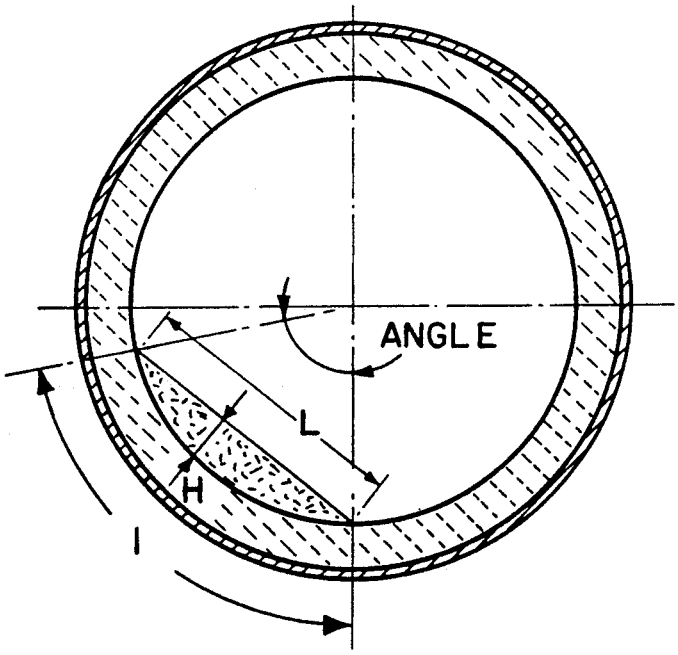
FIG. 7 Prior Art
FIG. 7 is a cross-sectional view of a cylindrical cross-sectional kiln according to the prior art which illustrates the degree of surface exposure of the burden to the lining and gases therein.

In an scale model circular cross-sectional kiln of an equivalent diameter, as illustrated in FIG. 7, only about 8 cm (L) is exposed to the gases and about 8.32 cm (l) is directly exposed to the lining, or a total of 22% less surface area when compared to the hexagon cross-sectional area kiln. As such, it should readily be obvious that heat transfer conditions, whether radiative or conductive, are more favorable in hexagonal cross sectional kilns and generally in polygonal cross sectional kilns than in cylindrical cross sectional kiln due to the larger surface area of the burden exposed to the gases and lining.

A still further factor important in achieving the higher heat efficiency is the achievement of a more robust dispersion or mixing of the material as it traverses forward through the kiln. Conventional art teaches the use of refractory cams and lifters for mixing the material since they tumble the material on itself; thereby, exposing new material surface to the gases and hot lining. Ceramic or refractory cams and lifters pinch spall, however, whereas metallic ones oxidize and fatigue, therefore losing their effectiveness.

The inventive polygonal lining design improves the tumbling effect of the rotary kiln which, in turn, allows the material to have less contact time with the lining, allowing other particles to be more quickly reheated. This design specifically inhibits the sliding of the material by agitating the material or burden without substantially lifting it.

In one experiment, the movement of 500 grams of a 50% mixture of chromite sand (black) and glass sand (white) through polygonal and cylindrical cross sectional kilns shown in FIGS. 6, and 7, respectively was observed. These burdens were used particularly because of their color contrast and difference in bulk densities so as to facilitate the visual inspection of any segregation within the kiln.

For the cylindrical cross-sectional kiln, the burden or material zig-zags, that is rises and falls along the lining, without tumbling approximately 70 times within a one minute time period. However, for the polygonal kiln, it was observed that the material tumbled about 16 times during a one minute time period. Moreover, it was observed that while there was a segregation of the materials in the cylindrical cross sectional kiln, none existed in the polygonal cross sectional kiln. Such an enhanced tumbling or mixing allows a more evenly heat distribution to a larger percentage of the material.

It should be understood that for kilns of commercial dimensions the polygonal lining will generally cover a minimum of 30 feet at the calcining zone and at least 20 feet at the discharge end of the kiln. Moreover, for these size kilns, it is anticipated that between 6 and 12 sides will be required to improve the heat efficiency.

EXAMPLES

The present invention is illustrated by the following non-limiting examples of preferred lining construction.

EXAMPLE 1

Figure 8:
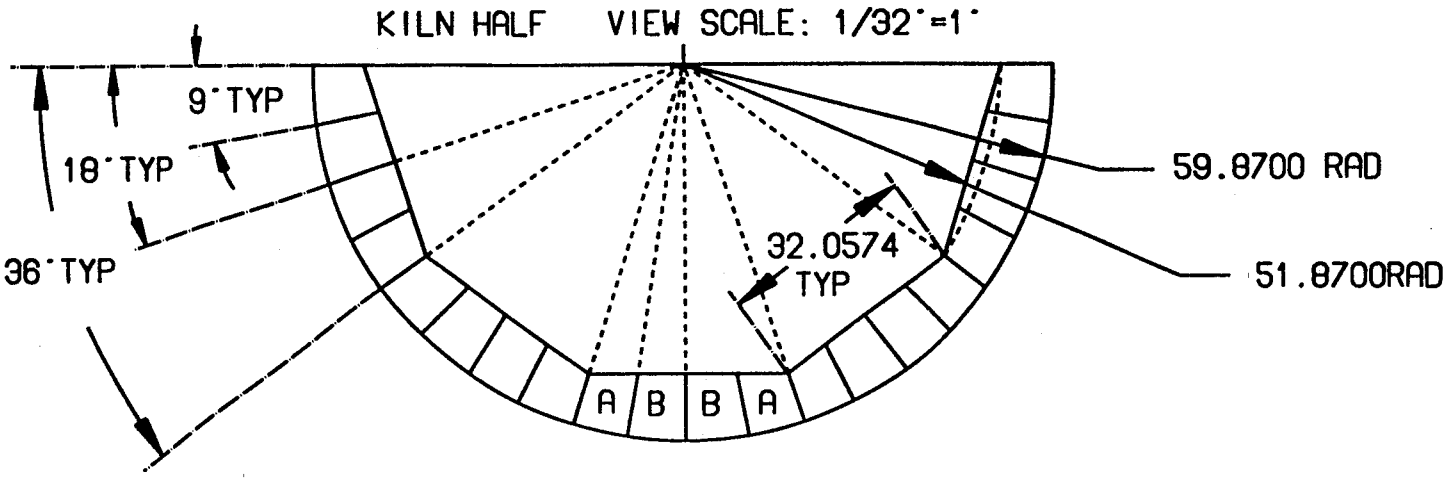
FIG. 8 is a cross-sectional view of half of a 10 sided polygonal cross-sectional lining for the kiln of Example 1.
Figure 9:
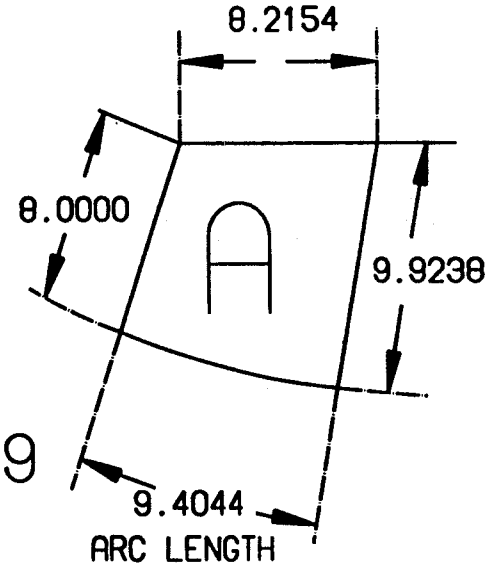

The inner wall of a 10 foot diameter kiln is provided with a ¼" layer of Lytherm 1535 GC (Lydall Co.), a ceramic fiber paper, as insulation. A layer of Zed Mullite (Zedmark Ind.) pressed and fired high alumina bricks is laid upon the blanket to prepare a ten sided polygon. As shown in FIG. 8, the bricks are configured and designed to conform to the shell and form the polygonal lining by placement thereon. To obtain a ten sided polygon, each of the sides can be made of 4 blocks (two sets of two different tapered blocks in an ABBA sequence as shown). The A and B blocks, shown in FIGS. 9 and 10, each have a thickness of about 4". The bricks are mechanically retained in the desired position by the tapered edges, and are prevented from moving away from the shell as it is rotated. The last block to be installed can be slid into the opening to bind the entire polygonal design together. Where necessary, an air set dry mortar may be used to fill irregularities between the bricks or between the bricks and the shell. After completing a first course of bricks circumferentially around the shell, additional courses are installed until the lining is completed.

EXAMPLE 2

The inner wall of a 12 foot diameter kiln is provided with a plurality of standard "V" anchors of type 310 stainless steel in a predetermined staggered pattern. The anchors were configured and arranged to extend from the shell by a distance of approximately ⅔ the total thickness of the lining. Wood forms were used to provide an outline for a lining to be cast in the configuration of a ten sided polygon of a size essentially the same as that of Example 1. The forms outline an area equal to one side of the polygon along a desired length of no more than about 16.4 feet (5 meters) to avoid imbalancing the kiln during installation. An initial layer of an insulative refractory material of Hyal-Lite 30 (Zedmark, Inc.) is applied to the encasing at about half the thickness of the total lining. Rod vibrators were used to assure proper casting of the ceramic slurry. After this material cures, the remainder of the lining was placed in the forms using Zedal Cast 60 LC (Zedmark, Inc.). Again, rod vibrators were used to assure proper and complete placement of the ceramic slurry without air-pockets. The second layer was then allowed to cure. The final cast ceramic lining was completed in segments having a cross sectional configuration which is essentially the same as that of the ABBA bricks of Example 1. This procedure was repeated along the length of the first side and then for the additional sides of the polygon until the entire lining was installed.

It is understood that various other modifications will be readily apparent to those skilled in the art without departing from the scope and spirit of this invention. For example, the lining may be made of a ramming plastic, or gunned in place refractory, without the use of forms. Accordingly, it is not intended that the scope of the claims appended hereto be limited to the description set forth herein, but rather that the claims be construed as encompassing all the features of patentable novelty that reside in the present invention, including all features that would be treated as equivalents thereof by those skilled in the art to which this invention pertains.

What is claimed is:

1. A kiln for processing material comprising:

a shell having an inner wall and a longitudinal axis, and a lining disposed within and adjacent at least a portion of said wall and comprising N planar sides, with a selected width of each side being made from between two and six bricks of different size and shape disposed against said shell in a predetermined manner, for defining an open processing zone having a generally polygonal cross sectional configuration generally aligned along the longitudinal axis of said shell.

2. The kiln of claim 1 further comprising:

a supporting structure; and means for rotatably supporting said kiln on said supporting structure.

3. The kiln of claim 1 wherein the first end of the shell is positioned relative to the second end to cause the burden to move toward the second end as the shell is rotated.

4. The kiln of claim 1 wherein the sides of the polygonal lining are connected by a mismatched, straight or curved transition area.

5. A kiln for processing material with high-temperature gases, said kiln comprising:

a shell having an inner wall, first and second ends, and a longitudinal axis;

feeding means operatively associated with the first end of the shell for feeding a burden of processable material into the kiln;

means for rotating the shell;

a refractory lining disposed within and adjacent at least a portion of said inner wall and having a generally polygonal cross sectional configuration generally aligned along the longitudinal axis of said shell and including N planar sides with a selected width of each side being made from between two and six bricks of different size and shape disposed against said shell in a predetermined manner, for defining an open processing zone for repeatedly exposing a substantial portion of the burden to high temperature gases as the shell is rotated; and an output opening operatively associated with the second end of the shell for allowing the burden to exit the kiln.

6. The kiln of claim 5 wherein N is between 3 and 12 such that the angle between adjacent sides of the polygonal cross-section is about 150 degrees or less.

7. The kiln of claim 6 further comprising a layer of a heat insulating material positioned between the wall and the brick lining.

8. The kiln of claim 5 further comprising a layer of a heat insulating material positioned between the wall and the cast lining.

9. A kiln for processing material with high-temperature gases, said kiln comprising:

a cylindrical shell having an inner wall, first and second ends, and a longitudinal axis;

feeding means operatively associated with the first end for feeding a burden of processable material into the shell;

means for rotating the shell;

a lining disposed within and adjacent said inner wall and comprising N planar sides, with a selected width of each side being made from between two and six bricks of different size and shape disposed against said shell in a predetermined manner, for defining an open processing zone having a generally polygonal cross sectional configuration along the longitudinal axis of said shell for repeatedly exposing a substantial portion of the burden to the high temperature gases as the shell is rotated by said rotating means; and an output opening at the second end of the shell for removing the burden after it passes through the processing zone.

10. A kiln for processing material with high temperature gases, said kiln comprising:

a cylindrical shell having an inner wall, first and second ends, and a longitudinal axis;

feeding means operatively associated with the first end for feeding a burden of processable material into the shell;

means for rotating the shell;

a lining disposed within and adjacent the inner wall and comprising a ceramic or refractory material cast thereupon for defining an open processing zone having a generally polygonal cross sectional configuration aligned along the longitudinal axis of said shell and including N planar side for repeatedly exposing a substantial portion of the burden to high temperature gases as the shell is rotated, with a selected width of each side of the lining material being cast from between two and six components of different size and shape;

a plurality of anchoring members attached to the wall in a predetermined pattern for anchoring said cast lining thereto; and an output opening at the second end of the shell for removing the burden after it passes through the processing zone.

11. The kiln of claim 10 which further comprises a plurality of anchoring members attached to the inner wall in a predetermined pattern for anchoring said cast lining to the wall.

12. The kiln of claim 10 wherein said refractory lining includes a first layer adjacent the inner wall and a second layer which faces the open processing zone.

13. The kiln of claim 12 wherein the first layer has relatively heat insulating properties compared to the second layer; and the second layer has relatively higher heat and abrasion resistance compared to the first layer.

14. The kiln of claim 12 wherein the first layer has relatively heat insulating properties compared to the second layer.

15. The kiln of claim 12 wherein the second layer has relatively higher heat and abrasion resistance compared to the first layer.

16. A method for processing material which comprises:

forming a kiln for processing material with high-temperature gases, said kiln comprising: a shell having an inner wall, first and second ends, and a longitudinal axis; feeding means operatively associated with the first end of the shell for feeding a burden of processable material into the kiln; means for rotating the shell; a refractory lining disposed within and adjacent at least a portion of said inner wall and having a generally polygonal cross sectional configuration generally aligned along the longitudinal axis of said shell and including N planar sides with a selected width of each side being made from between two and six bricks of different size and shape disposed against said shell in a predetermined manner, for defining an open processing zone for repeatedly exposing a substantial portion of the burden to high temperature gases as the shell is rotated; and an output opening operatively associated with the second end of the shell for allowing the burden to exit the kiln;

feeding a burden of material to be processed into the shell of the kiln and onto the lining thereof; and rotating the shell about its axial length so that the burden is processed as it passes therethrough.

17. A method for processing material which comprises:

forming a kiln for processing material with high-temperature gases, said kiln comprising: a cylindrical shell having an inner wall, first and second ends, and a longitudinal axis; feeding means operatively associated with the first end for feeding a burden of processable material into the shell; means for rotating the shell; a lining disposed within and adjacent said inner wall and comprising N side, with a selected width of each side being made from between two and six bricks of different size and shape disposed against said shell in a predetermined manner, for defining an open processing zone having a generally polygonal cross sectional configuration along the longitudinal axis of said shell for repeatedly exposing a substantial portion of the burden to high temperature gases as the shell is rotated by said rotating means; and an output opening at the second end of the shell for removing the burden after it passes through the processing zone;

feeding a burden of material to be processed into the shell of the kiln and onto the lining thereof; and rotating the shell about its axial length so that the burden is processed as it passes therethrough.

18. A method for processing material which comprises:

forming a kiln for processing material with high-temperature gases, said kiln comprising: a cylindrical shell having an inner wall first and second ends, and a longitudinal axis; feeding means operatively associated with the first end for feeding a burden of processable material into the shell; means for rotating the shell; a lining disposed within and adjacent the inner wall and comprising a ceramic or refractory material cast thereupon for defining an open processing zone having a generally polygonal cross sectional configuration aligned along the longitudinal axis of said shell including N planar sides for defining an open processing zone for repeatedly exposing a substantial portion of the burden to high temperature gases as the shell is rotated, with a selected width of each side of the lining material being cast from between two and six components of different size and shape; a plurality of anchoring members attached to the wall in a predetermined pattern for anchoring said cast lining thereto; and an output opening at the second end of the shell for removing the burden after it passes through the processing zone;

feeding a burden of material to be processed into the shell of the kiln and onto the lining thereof; and rotating the shell about its axial length so that the burden is processed as it passes therethrough.

19. A method for processing material which comprises:

forming a processing zone which has N planar sides and a longitudinal axis by casting a selected width of each side of the zone as a refractory lining in the form of between two and six components of different size and shape and arranging the components to have a generally polygonal cross-sectional configuration along the longitudinal axis of the zone;

feeding a burden of material to be processed into the processing zone and onto the lining;

rotating the processing zone for repeatedly exposing a substantial portion of the burden to the environment within the processing zone; and directing the burden after processing thereof away from the processing zone.

20. The method of claim 19 which further comprises including high temperature gases as part of the environment of the processing zone, and forming the polygonal boundary of the processing zone of a material which is resistant to the gases and the burden of material to be processed.

21. The method of claim 20 wherein the processing zone is formed of between about 3 to 12 sides such that the angle between adjacent sides of the polygonal cross-section is about 150 degrees or less and which further comprises providing a mismatched, straight or curved transition area between adjacent sides.

22. The method of claim 19 which further comprises incorporating the processing zone as a portion of a rotary kiln.

* * * * *